US007194223B2

(12) United States Patent
Hachisuga

(10) Patent No.: US 7,194,223 B2
(45) Date of Patent: Mar. 20, 2007

(54) TANDEM TYPE IMAGE FORMING APPARATUS

(75) Inventor: Takaaki Hachisuga, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 128 days.

(21) Appl. No.: 11/004,947

(22) Filed: Dec. 7, 2004

(65) Prior Publication Data

US 2006/0120747 A1 Jun. 8, 2006

(51) Int. Cl.
*G03G 21/20* (2006.01)
*G03G 15/01* (2006.01)

(52) U.S. Cl. ..... 399/92; 399/93; 399/223

(58) Field of Classification Search ..... 399/92, 399/93, 98, 99, 102, 103, 223, 299, 302, 399/343, 358

See application file for complete search history.

(56) References Cited

U.S. PATENT DOCUMENTS 4,970,552 A * 11/1990 Okamoto et al. ..... 399/98
5,028,959 A * 7/1991 Gooray ..... 399/93
5,608,499 A * 3/1997 Tanaka ..... 399/99
6,324,374 B1 * 11/2001 Sasamoto et al. ..... 399/302 X
6,463,236 B2 * 10/2002 Morikami et al. ..... 399/302 X
6,990,304 B2 * 1/2006 Mitamura et al. ..... 399/302 X
7,027,753 B2 * 4/2006 Suzuki ..... 399/103
7,031,637 B2 * 4/2006 Fujita ..... 399/223 X
2004/0062570 A1 4/2004 Hachisuga

FOREIGN PATENT DOCUMENTS

JP 2001-125337 A 5/2001
JP 2003-156908 A 5/2003

* cited by examiner

*Primary Examiner*—Sandra L. Brase
(74) *Attorney, Agent, or Firm*—Foley & Lardner LLP

(57) ABSTRACT

In a tandem type image forming apparatus of this invention provided with image forming units arranged under an intermediate transfer medium and further, an exposure device arranged under the image forming units, developing devices are arranged so that exposure positions of image carriers and developing rollers come to the opposite sides with toner stirring mixers put between them. Further, there are guides extending under cleaning blades below the cleaning blades to receive falling toners. Further, suction ducts are provided to suck in the air around the developing devices. A slit area formed by the guides and an area of a laser beam projecting unit of the exposure device are arranged while they are shifted. Formed images are exposed at a sufficient exposure light intensity by preventing the laser beam injection unit of the exposure device from being stained and a toner image of high quality is obtained.

11 Claims, 4 Drawing Sheets

TANDEM TYPE IMAGE FORMING APPARATUS

BACKGROUND OF THE INVENTION

1. Field of the Invention

The present invention relates to an image forming apparatus to obtain a color image by superposing plural colored images in an electro-photographic copier or printer.

2. Description of the Related Art

In such image forming apparatus as copiers/printers, a tandem type image forming apparatus to obtain a color image by transferring multiple toner images formed on the plural number of photosensitive drums arranged in parallel is known. In such the tandem type image forming apparatus as this, the apparatus is demanded to be small in size despite of plural number of photosensitive drums arranged in recent years. In the Japanese Patent Application Publication No. 2001-125337, an image forming apparatus with the plural number of image forming units arranged in a row below an intermediate transfer belt is disclosed. This conventional image forming apparatus is in a structure that the image forming units are arranged below an intermediate transfer medium and two-component developing units are arranged under photosensitive drums. Thus, in the conventional image forming apparatus, stabilized amounts of developers are supplied, a space for developing units is saved and the image forming apparatus is downsized.

However, in this conventional tandem type image forming apparatus, an exposing device to expose a photosensitive drum of image forming unit is arranged below the developing unit. Furthermore, because of the developing rollers of the developing units are positioned close to the exposing positions, toners scattered from the upper developing rollers fall and accumulate on the upper surface of the exposing device. That is, a laser projection window of the laser beam exposure device is stained and the laser is intercepted by dropping matters such as scattered toners, etc. and image quality can be deteriorated.

Therefore, a tandem type image forming apparatus capable of preventing the stain of the laser projection window of an exposing device arranged below developing units by scattering toners and forming good and stable electrostatic latent images irrespective of plural image forming units arranged along the lower side of an intermediate transferring belt is so far demanded.

SUMMARY OF THE INVENTION

It is an object of the present invention to obtain toner images of high quality while preventing the laser projecting portion of an exposing device from being stained by falling matters such as scattering toners when an exposing device is provided below the developing units of the image forming units and exposing formed electrostatic latent images with stabilized light exposure in a tandem type image forming apparatus.

According to the embodiment of this invention, there is provided an image forming apparatus comprising an intermediate transfer medium; plural image forming units with charging means, exposure positions, developing means and cleaning means arranged around image carriers and put in order along the underside of the intermediate transfer medium; and exposing means arranged at the underside of the image forming units for irradiating exposure light corresponding to image data to the exposure positions, characterized by the developing means have developer supply members to supply developers to the image carriers and developer stirring units to stir the developers and are arranged around the image carriers in the direction with the developer stirring units put between the developing positions and the developing members.

DETAILED DESCRIPTION OF THE EMBODIMENTS

Figure 1:
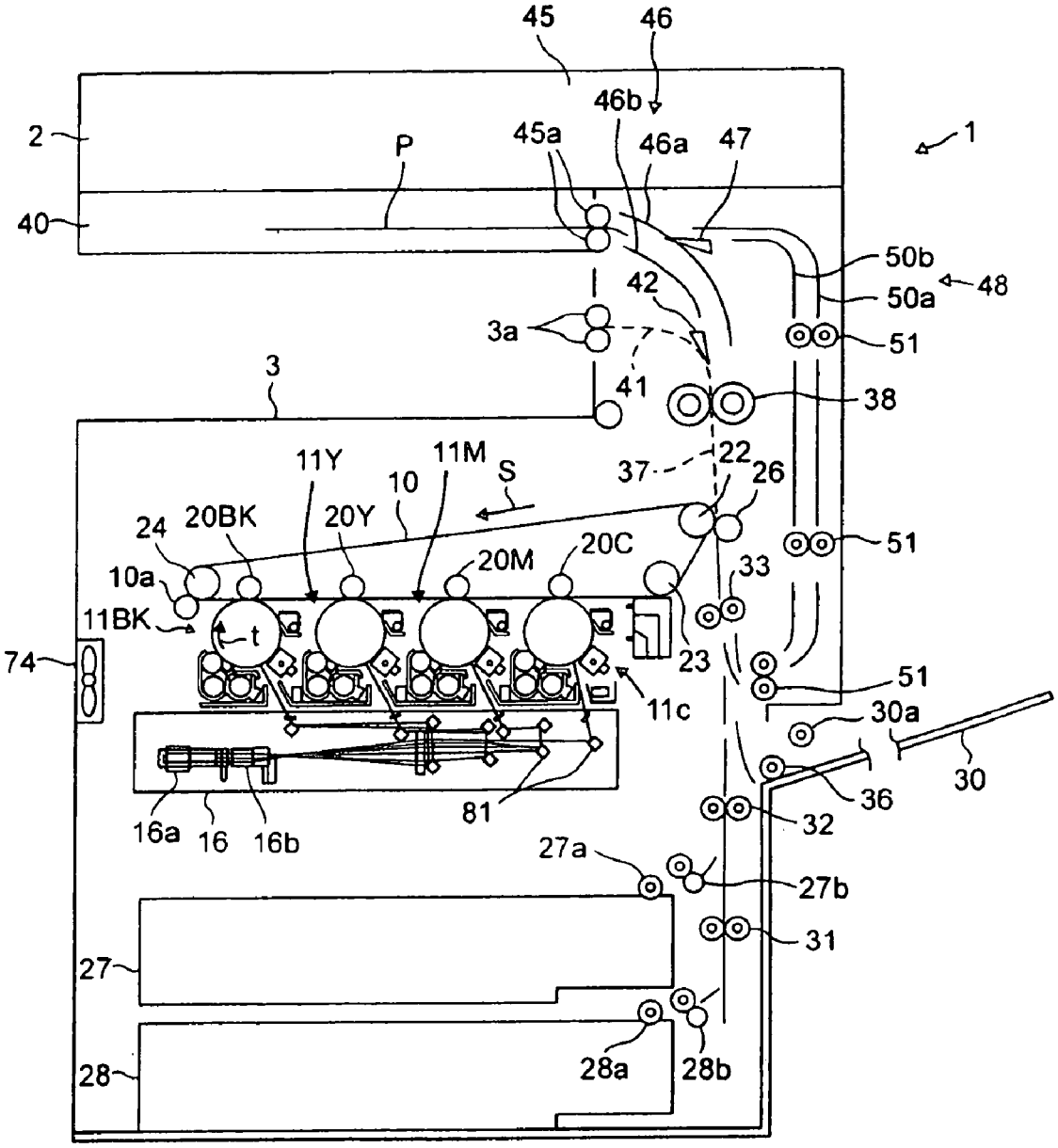
FIG. 1 is a schematic construction diagram showing a color copier in the embodiments of this invention.

The embodiments of this invention will be described below in detail referring to the attached drawings. FIG. 1 is a schematic construction diagram of a 4-tandem color copier 1 that is an image forming apparatus in the embodiments of this invention. This color copier 1 is provided with a scanner unit 2 and a paper discharging unit 3 on the upper portion. The color copier 1 has 4 sets of image forming units 11BK, 11Y, 11M and 11C arranged in parallel along the lower side of an intermediate transfer belt 10 that is a intermediate transfer medium.

Image forming units 11BK, 11Y, 11M and 11C have photosensitive drums 12BK, 12Y, 12M and 12C, respectively. Intermediate transfer belt 10 is made of, for example, semiconductive polyimide that is a stable material from the viewpoint of heat resistance as well as abrasion resistance. Intermediate transfer belt 10 is put over a driving roller 22 and driven rollers 23, 24 and are opposed to and put kept in contact with photosensitive drums 12BK, 12Y, 12M and 12C above image forming units 11BK, 11Y, 11M and 11C. Primary transfer voltage of about +1000V is applied to the primary transfer position of intermediate transfer belt 10 opposing to photosensitive drums 12BK, 12Y, 12M and 12C by primary transfer rollers 20BK, 20Y, 20M and 20C, and toner images formed on photosensitive drums 12BK, 12Y, 12M and 12C are primarily transferred on the intermediate transfer belt.

At the secondary transfer position supported by a driven roller 22 on which intermediate transfer belt 10 is put over, a secondary transfer roller 26 is arranged opposing to driven roller 22. At the secondary transfer position, the secondary transfer voltage of about +1000V is applied by secondary transfer roller 26 through a sheet paper P and a toner image on intermediate transfer belt 10 is secondarily transferred on a sheet paper P. At the downstream of secondary transfer roller 26 of intermediate transfer belt 10, a belt cleaner 10*a* is provided.

Image forming units 11BK, 11Y, 11M and 11C are provided with main chargers 13BK, 13Y, 13M and 13C that are charging means, exposing positions 17BK, 17Y, 17M and 17C, developing units 18BK, 18Y, 18M and 18C that are developing means, primary transferring rollers 20BK, 20Y, 20M and 20C, cleaning units 21BK, 21Y, 21M and 21C that are cleaning means arranged around photosensitive drums 12BK, 12Y, 12M and 12C, respectively along the arrow direction t that is the rotating direction of them. Image forming units 11BK, 11Y, 11M and 11C can be pulled out to the front side of the main body of color copier 1 and therefore, the driving systems of photosensitive drums 12BK, 12Y, 12M and 12C, main chargers 13BK, 13Y, 13M and 13C, exposing positions 17BK, 17Y, 17M and 17C, and developing units 18BK, 18Y, 19C and 18C are arranged at the rear side of the main body.

Exposing positions 17BK, 17Y, 17M and 17C form latent images in respective colors on photosensitive drums 12BK, 12Y, 12M and 12C by color laser beams 80BK, 80Y, 80M and 80C irradiated from a laser exposing device 16 that is an exposure means arranged under image forming units 11BK, 11Y, 11M and 11C based on image data from scanner unit 2, etc. Main chargers 13BK, 13Y, 13M and 13C of image forming units 11BK, 11Y, 11M and 11C fully charge the surfaces of photosensitive drums 12BK, 12Y, 12M and 12C uniformly to, for example, about −700V. Developing units 18BK, 18Y, 18M and 18C which are developing members applied with developing bias of about −500V supply two-component developers comprising black (BK), yellow (Y), magenta (M) and cyan (C) toners and carriers to photosensitive drums 12BK, 12Y, 12M and 12C by developing rollers 60BK, 60Y, 60M and 60C.

Cleaning units 21BK, 21Y, 21M and 21C remove residual toners on the surfaces of photosensitive drums 12BK, 12Y, 12M and 12C by cleaning blades 70BK, 70Y, 70M and 70C. Laser exposing device 16 scans the photosensitive drums 12BK, 12Y, 12M and 12C in the axial directions by applying laser beams projected from semiconductor devices through a polygon mirror 16*a* and focuses images on respective photosensitive drums 12BK, 12Y, 12M and 12C through a focusing lens system 16*b* and respective mirrors 81. At the color laser beam projecting portions 80BK, 80Y, 80M and 80C of laser exposing device 16, cover glasses 82BK, 82Y, 82M and 82C are provided.

Under laser exposing device 16 of color image forming apparatus 1, there are first and second paper supply cassette units 27 and 28 provided to supply sheet paper P in the direction of secondary roller 26. At the right side to color image forming apparatus 1, there is a manual tray 30 provided to manually supply sheet paper P. Between first and second paper supply cassettes units 27 and 28 and secondary transfer roller 26, pick-up rollers 27*a* and 28*a*, separation rollers 27*b* and 28*b*, first and second conveying rollers 31 and 32 and an alignment roller 33 are provided. Between manual tray 30 and alignment roller 33, a pick-up roller 30*a* to take out sheet paper P and a manual paper supply roller 36 are provided.

At the downstream of secondary transfer roller 26 along a vertical path 37 to convey sheet paper P supplied from paper supply cassettes 27 and 28 or manual tray 30 in the vertical direction, a fixing device 38 is provided.

On the upper surface of a paper discharge unit 3, a reversing area 40 that is a paper reversing portion is provided almost in parallel with paper discharge unit 3. On a paper discharging path 41 from fixing device 38 to paper discharge unit 3, a first gate 42 and a paper discharge roller 3*a* are provided. A paper reversing and conveying unit 45 from fixing device 38 to reversing area 40 has a reverse conveying path 46 and a switchback roller 45*a*.

On reverse conveying path 46, reversing guides 46*a* and 46*b* and a second gate 47 are provided. First gate 42 sorts sheet paper P to paper discharge unit 3 side or reverse conveying path 46 side. Switchback roller 45*a* is provided at the entrance of reversing area 40 and rotates sheet paper P in the normal rotating direction to convey it to reversing area 40 and in the reverse rotating direction to take out sheet paper from reversing area 40 to a re-conveying unit 48 side. Second gate 47 guides sheet paper P from reversing area 40 to the side of re-conveying unit 48. Re-conveying unit 48 is provided with re-conveying guides 50*a* and 50*b* to guide sheet paper P in the direction of second transfer roller 26 and a re-conveying roller 51.

Next, the arrangement of image forming units 11BK, 11Y, 11M and 11C and laser exposing device 16 will be described in detail. Developing devices 18BK, 18Y, 19M and 18C can be pulled out to the front side of the main body of color image forming apparatus by sliding on guides 61BK, 61Y, 61M and 61C. Developing devices 18BK, 18Y, 18M and 18C have toner stirring mixers 62BK, 62Y, 62M and 62C that are developer stirring units and toner supply mixers 63BK, 63Y, 63M and 63C that are developer supply units under developing rollers 60BK, 60Y, 60M and 60C as shown in FIG. 2.

Figure 3:
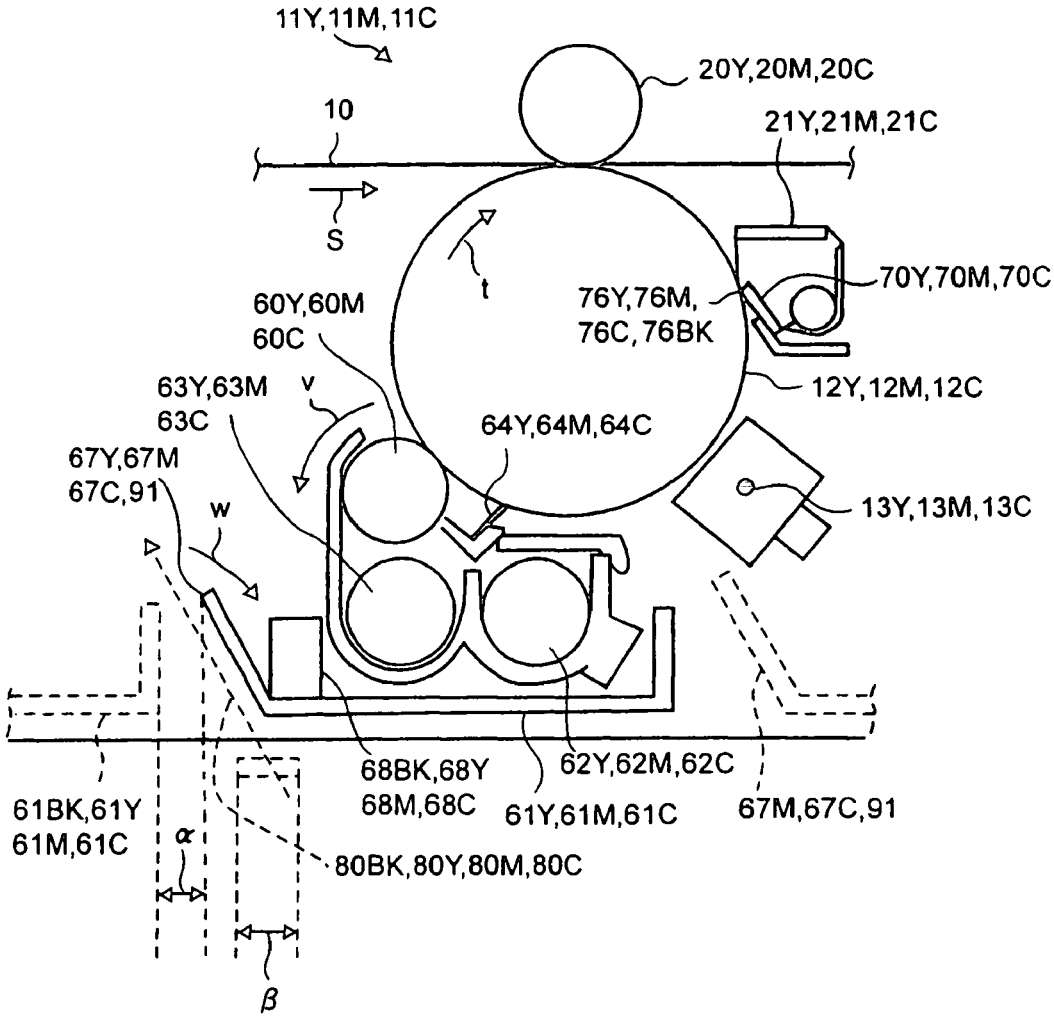
FIG. 3 is a schematic explanatory diagram showing the construction of an image forming unit in the embodiments of this invention.
Figure 4:
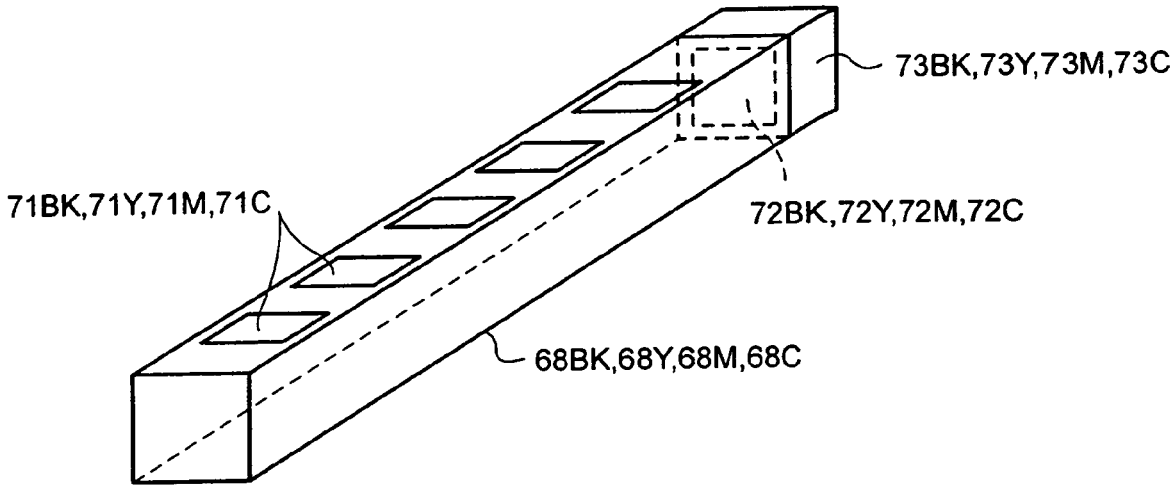
FIG. 4 is a schematic perspective view showing a suction duct in the embodiments of this invention.

Further, developing devices 18BK, 18Y, 18M and 18C are so arranged that exposing devices 17BK, 17Y, 17M and 17C and developing rollers 670BK, 60Y, 60M and 60C come to the opposite side via toner stirring mixers 62BK, 62Y, 62M and 62C as described in detail in FIG. 3. That is, developing devices 18BK, 18Y, 18M and 18C are arranged so that toner stirring mixers 62BK, 62Y, 62M and 62C come close to exposing positions 17BK, 17Y, 17M and 17C and developing rollers 60BK, 60Y, 60M and 60C come away from exposing positions 17BK, 17Y, 17M and 17C.

As a result, toner stirring mixers 62BK, 62Y, 62M and 62C are located below photosensitive drums 12BK, 12Y, 12M and 12C. On the upper surfaces of developing devices 18BK, 18Y, 18M and 18C, urethane made partition sheets 64BK, 64Y, 64M and 64C which are partition members to cut off the air flow between developing rollers 60BK, 60Y, 6GM and 60C and exposing positions 17BK, 17Y, 17M bad 17C are provided. Partition sheets 64BK, 64Y, 64M and 64C are extending from the upper surfaces of developing devices 18BK, 18Y, 18M and 18C to the surfaces of photosensitive drums 12BK, 12Y, 12M and 12C. Further, under cleaning unit 21C of image forming unit 11C, a guide 90 is provided.

Figure 2:
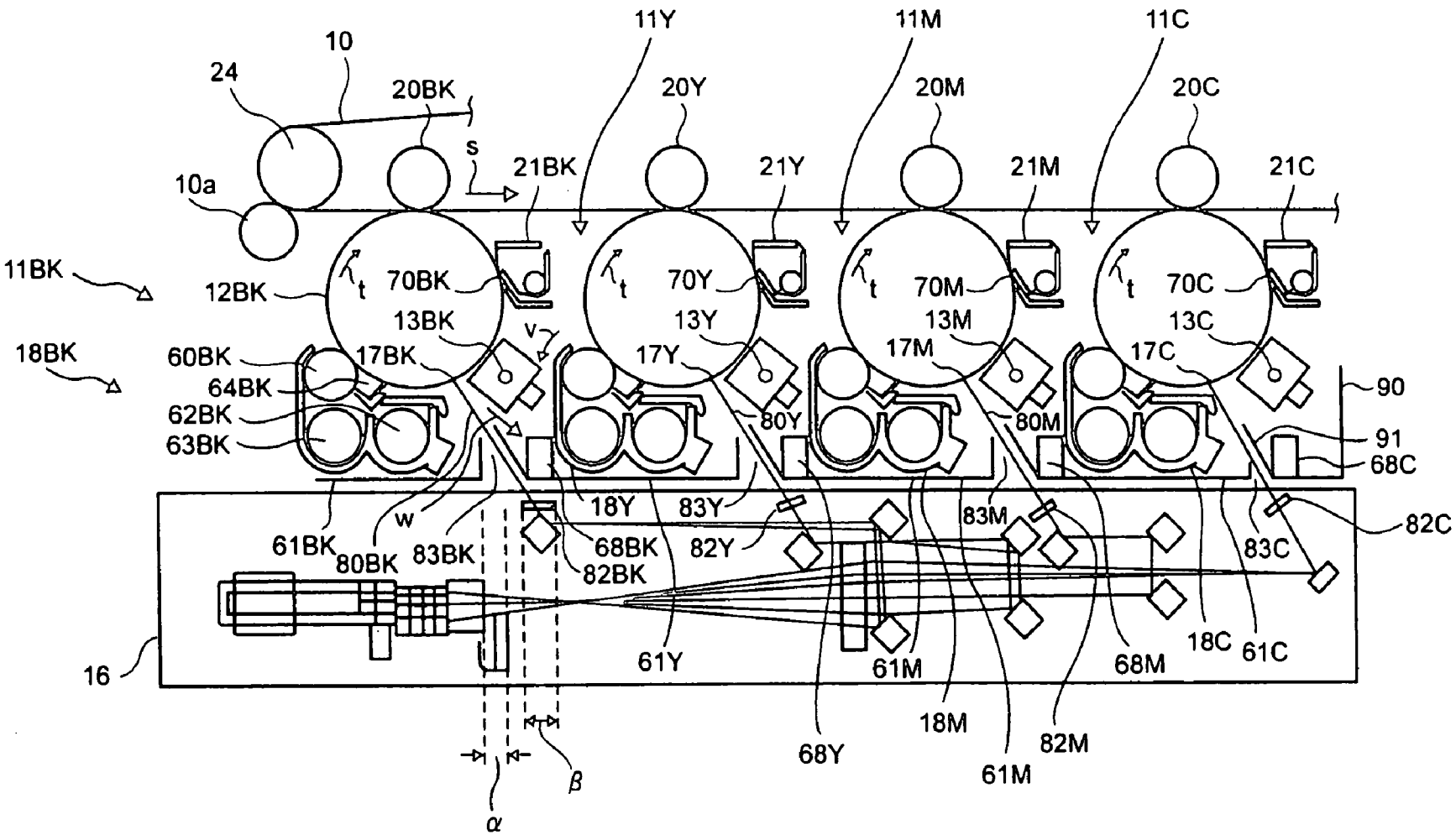
FIG. 2 is a schematic explanatory diagram showing the arrangement of image forming units, guides and a laser exposing device in the embodiments of this invention.

The left end portions of guides 61Y, 61M, 61C and 90 in FIG. 2 form slits 83BK, 83Y, 83M and 83C so that the optical paths of laser beams 80BK, 80Y, 8GM and 80C irradiated from laser exposing device 16 are not intercepted. The right end portions of guides 61BK, 61Y, 61M and 61C adjacent to the left sides of guides 61Y, 61M, 61C and 90 become the wall comprising slits 83BK, 83Y, 83M and 83C. Laser beams 80BK, 80Y, 8OM and 80C irradiated from the irradiation unit pass through slits 83BK, 83Y, 83M and 83C and irradiated to exposure positions 17BK, 17Y, 17M and 17C of photosensitive drums 12BK, 12Y, 12M and 12C. At the left end portions of guides 61BK, 61Y, 61M, 61C and 90, rising portions 67Y, 67M and 67C that are foreign matter receiving portions extending under cleaning units 21BK, 21Y, 21M, 21C and 91 are formed aslant along the light paths of laser beams 80BK, 80Y, 8OM and 80C.

The front edge portions of rising portions 67Y, 67M, 67C and 91 are extending in the center direction of photosensitive drums 11BK, 11Y, 11M and 11C farther than edge surfaces 76BK, 76Y, 76M and 76C that are the positions of cleaning blades 70BK, 70Y, 70M and 70C to contact with photosensitive drums 11BK, 11Y, 11M and 11C.

Accordingly, even when removed toners dropped from cleaning blades 70BK, 70Y, 70M and 70C, guides 61BK, 61Y, 61M and 61C can receive dropped toners.

Further, the ends of rising portions 67Y, 67M, 67C and 91 are extending to the upper surfaces of cover glasses 82BK, 82Y, 82M and 82C of laser exposing device 16 in the toner dropping direction and cover the upper portions of the projecting portions of laser beams 80BK, 80Y, 80M and 80C. Further, as shown in FIG. 2, areas α of slits 83BK, 83Y, 83M and 83C of laser beams 80BK, 80Y, 80M and 80C at the front edges of rising portions 67Y, 67M, 67C and 91 are so arranged not to overlap on the areas β covered by cover glasses 82BK, 82Y, 82M and 82C of laser exposing device 16 when viewed from the toner dropping direction. Accordingly, even if removed toners and other foreign matters dropped in the direction of laser exposing device 16 from slits 83BK, 83Y, 83M and 83C, foreign matters do not accumulate on cover glasses 82BK, 82Y, 82M and 82C.

Further, between rising portions 67Y, 67M and 67C of guides 61Y, 61M and 61C and developing devices 18Y, 18M and 18C, suction ducts 68BK, 68Y and 68M are provided and further, suction duct 68C is provided to guide 90. Suction ducts 68BK, 68Y, 68M and 68C have openings 71BK, 71Y, 71M and 71C on the upper surface opposing to cleaning units 21BK, 21Y, 21M and 21C and air suction openings 72BK, 72Y, 72M and 72C at the rear side of the main body of color image forming apparatus 1.

Air suction openings 72BK, 72Y, 72M and 72C are provided with ozone filters 73BK, 73Y, 73M and 73C that are ozone removing means. The air in suction ducts 68BK, 68Y, 68M and 68C is exhausted from color image forming apparatus 1 by a suction unit 74 through ozone filters 73BK, 73Y, 73M and 73C. As a result of the air suction, the airflow in the arrow directions v and w toward openings 71BK, 71Y, 71M and 71C are generated in the vicinity of suction ducts 68BK, 68Y, 68M and 68C.

Next, the operations will be described. When the image formation is started and image data are input through a scanner/PC terminal, photosensitive drums 12BK, 12Y, 12M and 12C are rotated and the image forming processes are carried out sequentially in image forming units 11BK, 11Y, 11M and 11C. In black (BK) image forming unit 11BK, the surface of photosensitive drum 12BK is uniformly charged to, for example, −700V by main charger 13BK.

Then, laser beam corresponding to black (BK) image data is applied to sensitive drum 12BK by laser exposing device 16 and an electrostatic latent image is formed thereon. Further, developing bias of about −500V is applied to photosensitive drum 12BK and a black (BK) toner image is formed through the reverse development by developing roller 60BK. Then, photosensitive drum 12BK is brought kept in contact with intermediate transfer belt 10 rotating in the arrow direction s and the black (BK) toner image is primarily transferred on intermediate transfer belt 10 by primary transfer roller 20.

In the same manner as in this black (BK) toner image forming process, the yellow (Y), magenta (M) and cyan (C) toner image processes are carried out. The toner images formed on respective photosensitive drums 12Y, 12M and 12C are transferred sequentially on the same position where the black (BK) toner image was formed on intermediate transfer belt 10. Thus, a full-color toner image formed by multiply transferring black (BK), yellow (Y), magenta (M) and cyan (C) toner images is obtained on intermediate transfer belt 10. Then, intermediate transfer belt 10 transfers the full-color toner image obtained by superposing black (BK), cyan (C), magenta (M) and yellow (Y) toner images at the position of secondary transfer roller 26 collectively secondarily on a sheet paper P.

A sheet paper P is supplied to the position of secondary transfer roller 26 from paper supply cassettes 27, 28 or manual tray 30 synchronously when a full-color toner image on intermediate transfer belt 10 reaches secondary transfer roller 26. The sheet paper P with the full-color toner image secondary transferred reaches a fixing device and the toner image is fixed. On the other hand, after completing the secondary image transfer, intermediate transfer belt 10 is cleaned by removing residual toners with belt cleaner 10*a*. Further, after toner images formed are transferred primarily on intermediate transfer belt 10 and residual toners are removed by cleaning units 21BK, 21Y, 21M and 21C, and photosensitive drums 12BK, 12Y, 12M and 12C become ready for the next image forming process.

The sheet paper P with a full-color toner image fixed thereon is sorted to a first gate 42 when it has an image on one side and discharged to paper discharge unit 3. Futher, when a sheet paper P has an inage on both sides or the multiple printing is needed, the sheet paper P is sorted to reverse conveying path 46 through first gate 42 after passing fixing unit 38, and is reversed in the reversing area and conveyed again to the position of secondary transfer roller 26 in the as-is state by re-conveying unit 48.

While such the image forming process is carried out, toners may scatter to the surrounding area as a result of the rotation of developing rollers 60BK, 60Y, 60M and 60C in respective image forming units 11BK, 11Y, 11M and 11C. When these scattered toners are accumulated on cover glasses 82BK, 82Y, 82M and 82C of laser exposing device 16, laser beams 80BK, 80Y, 80M and 80C are intercepted and luminous exposure intensity reaching exposure positions 17BK, 17Y, 17M and 17C drop and image quality will be deteriorated.

However, around photosensitive drums 12BK, 12Y, 12M and 12C of image forming units 11BK, 11Y, 11M and 11C, developing units 18BK, 18Y, 18M and 18C are so arranged that toner stirring mixers 62BK, 62Y, 62M and 62C come close to exposing positions 17BK, 17Y, 17M and 17C, and developing rollers 60BK, 60Y, 60M and 60C come away from exposure positions 17BK, 17Y, 17M and 17C. Further, developing rollers 60BK, 60Y, 60M and 60C are partitioned from exposure positions 17BK, 17Y, 17M and 17C by partition sheets 64BK, 64Y, 64M and 64C.

Thus, in image forming units 11BK, 11Y, 11M and 11C, it becomes difficult for toners scattering from developing rollers 60BK, 60Y, 60M and 60C to reach the projecting portions of laser beams 80BK, 80Y, 80M and 80C of laser exposing device 16. That is, the cover glasses 82BK, 82Y, 82M and 82C of the projecting portion are prevented from being contaminated by scattered toners is prevented.

Although the laser beam projecting portion is subject to the effect of spattering toners from developing rollers 60Y, 60M and 60C of adjacent image forming units 11Y, 11M and 11C, scattered toners are collected in suction ducts 68BK, 68Y, 68M and 68C by the air flow in the arrow directions v and w among developing devices 18Y, 18M and 18C or by suction ducts 68BK, 68Y, 68M and 68C provided in guide 90, and cover glasses 82BK, 82Y, 82M and 82C of the laser beam projection portion is prevented from being contaminated.

Further, removed toners accumulated on edge surfaces 76BK, 76Y, 76M and 76C of cleaning blades 70BK, 70Y, 70M and 70C may drop down during the image forming process or the maintenance. However, there are rising portions 67Y, 67M and 67C of guides 61Y, 61M and 61C of adjacent developing devices 18Y, 18M and 18C extending below edge surfaces 76BK, 76Y, 76M and 76C and also rising portion 91 of guide 90 is extending. Therefore, even when removed toners dropped on guides 61Y, 61M, 61C and 90, they do not reach cover glasses 82BK, 82Y, 82M and 82C of laser exposing device 16.

Further, the area β of the laser projecting portion covered by cover glasses 82BK, 82Y, 82M and 82C of laser exposing device 16 is different from the area α of slits 83BK, 83Y, 83 and 83C of laser beams 80BK, 83Y, 83M and 83C and does not wrap over the area α when viewed from the toner dropping direction and therefore, foreign matters dropped from slits 83BK, 83Y, 83M and 83C do not reach cover glasses 82BK, 82Y, 82M and 82C.

According to this embodiment, in the tandem type color image forming apparatus 1, image forming units 11BK, 11Y, 11M and 11C are arranged under intermediate transfer belt 10 and in image forming units 11BK, 11Y, 11M and 11C, developing devices 18BK, 18Y, 18M and 18C can be arranged under photosensitive drums 12BK, 12Y, 12M and 12C. And the width of color image forming apparatus 1 can be reduced as a result of reduction in the widths of image forming units 11BK, 11Y, 11M and 11C.

Furthermore, despite of laser exposing device 16 arranged under developing devices 18BK, 18Y, 18M and 18C, developing rollers 60BK, 60Y, 60M and 60C are arranged away from exposure positions 17BK, 17Y, 17M and 17C and further, developing rollers 60BK, 60Y, 60M and 60C are cut off from exposure positions 17BK, 17Y, 17M and 17C with partition sheets 64BK, 64Y, 64M and 64C and therefore, cover glasses 82BK, 82Y, 82M and 82C of laser exposing device 16 are prevented from being soiled by scattering toners and the image quality can be further improved by the good exposure.

Further, suction ducts 68BK, 68Y and 68M are provided between adjacent guides 61Y, 61 and 61C and developing devices 18Y, 18M and 18C, and further, suction duct 68C is provided for guide 90. Therefore, toners scattering as a result of the rotation of developing rollers 60BK, 60Y, 60M and 60C and dropping from upper cleaning units 21BK, 21Y, 21M and 21C are collected in suction ducts 68BK, 68Y, 68M and 68C. Thus, cover glasses 82BK, 82Y, 82M and 82C of laser exposing device 16 can be prevented from being stained by scattering toners and the improved image quality by the good exposure is obtained. Furthermore, suction ducts 68BK, 68Y, 68M and 68C are provided with ozone filters 73BK, 73Y, 73M and 73C and the clean environmental condition around the color image forming apparatus is maintained.

Further, as rising portions 67Y, 67M, 67C and 91 of guides 61Y, 61M, 61C and 90 are extending under edge surfaces 76BK, 76Y, 76M and 76C of cleaning blades 70BK, 70Y, 70M and 70C, removed toners remain on guides 61Y, 61M, 61C and 90 even when they dropped from cleaning blades 70BK, 70Y, 70M and 70C and cover glasses 82BK, 82Y, 82M and 82C of exposure device 16 are not soiled and the improved image quality by the good exposure is obtained.

Further, above cover glasses 82BK, 82Y, 82M and 82C of laser exposing device 16, rising portions 67Y, 67M, 67C and 91 of guides 61Y, 61M, 61C and 80 are extending to protect cover glasses 82BK, 82Y, 82M and 82C.

Further, the area α of slits 83BK, 83Y, 8M and 83C of laser beams 80BK, 80Y, 80M and 80C and the area β of the laser projecting portion covered by cover glasses 82BK, 82Y, 82M and 82C of laser exposing device 16 differ each other when viewed from the toner falling direction. Accordingly, even when foreign matters drop on laser exposing device 16 from slits 83BK, 83Y, 83M and 83C, the foreign matters do not reach cover glasses 82BK, 82Y, 82M and 82C and the cover glasses can be prevented from being stained.

Furthermore, it is not required to use a new material to prevent the contamination of the cover glasses and guides 61Y, 61M and 61C for sliding developing devices 18Y, 18M and 18C can be used for this purpose and a required space is further saved and the image forming apparatus can be made in a small size.

Further, this invention is not limited to the embodiments described above but can be modified variously within the scope thereof. When, for example, an image forming apparatus is of a tandem type with exposure devices arranged under developing devices, a number of image forming units, colors of developers or sequence of arrangement thereof are not restricted.

Further, the foreign matter receiving portion is also not used as a guide to slide a developing means but when used also as a guide, a required space can be saved and a cost can be reduced. In addition, when slits for securing the light paths of laser beams are provide without providing a guide for every developing means, a guide may be formed integrally with an adjacently installing guide. Further, the structure of developing means is also not restricted and plural number of developer stirring means can be provided. Sizes of developing bias to be applied to developing devices are also not restricted.

According to this invention as described above, in a tandem type image forming apparatus, image forming units are arranged along the underside of the intermediate transfer belt and it is therefore possible to downsize the apparatus and execute the stabilized image development. Further, it is possible to prevent exposing devices from being stained by such foreign matters as scattering toners, falling toners, etc. by adjusting the arranged positions of image forming units, foreign matter receiving units and exposure devices or providing suction means and formed images can be developed at a sufficient luminous exposing light intensity. Accordingly, good and stable electrostatic latent images can be formed and then, high quality images can be obtained.

What is claimed is:

1. An image forming apparatus, comprising:

an intermediate transfer medium;

plural image forming units with charging means, exposure positions, developing means and cleaning means arranged around image carriers and put in order along the underside of the intermediate transfer medium;

exposing means arranged at the underside of the image forming units for irradiating exposure light corresponding to image data to the exposure positions;

a foreign matter recieving unit provided between the cleaning means and the exposure means; and an air suction unit provided in the space between the foreign matter recieving unit and the image forming unit wherein the developing means have developer supply members to supply developers to the image carriers and developers stirring units to stir the developers and are arranged around the image carriers om a moving direction of the image carriers with the developer stirring units put between the exposure positions and the developer supply members.

2. The image forming apparatus as claimed in claim 1 wherein the developing means have partition members extending to the image carriers at the positions opposite to the image carriers between the exposure positions and the developer supply members.

3. The image forming apparatus as claimed in claim 1 wherein the developing means are arranged under the image carriers.

4. The image forming apparatus as claimed in claim 1 wherein the developing means have developer supply units to supply developers stirred in the developer stirring units, and the exposing positions and the developer supply units are so arrange that they are opposite to each other with the developer stirring unit put between them and the developer supply members are arranged above the developer supply units around the image carriers.

5. The image forming apparatus as claimed in claim 4, wherein the developing means have partition members extending to the image carriers at the positions opposite to the image carrier between the exposure positions and the developer supply members.

6. The image forming apparatus as claimed in claim 1, wherein a foreign matter receiving unit is further provided between the cleaning means and the exposure means.

7. An image forming apparatus comprising:

an intermediate transfer medium;

plural image forming units with charging means, exposing positions, developing means and cleaning means arranged around image carriers and are put in order along the underside of the intermediate transfer medium;

exposing means having light projecting units to irradiate exposure light corresponding to image data to the exposing positions and arranged under the image forming units;

foreign matter receiving units provided between the cleaning means and the exposure means; and air suction means arranged in the spaces between the foreign matter receiving units and the image forming units.

8. The image forming apparatus as claimed in claim 7, wherein the cleaning means have cleaning blades kept in contact with the image carriers and the foreign matter receiving units are extending down below the edge surfaces of the cleaning blades and also up above the light projecting units.

9. The image forming apparatus as claimed in claim 7, wherein the air suction means are provided with ozone removing means.

10. The image forming apparatus as claimed in claim 7, wherein the foreign matter receiving units are adjacent to light paths extending from the laser beam projecting units to the exposure positions.

11. The image forming apparatus as claimed in claim 7, characterized in that the developing means have developer supply members to supply developers to the image carriers and developer stirring units to stir developers, and the developing means are arranged around the image carriers and the developer stirring units are positioned between the exposure positions and the developer supply members.

* * * * *